US009586800B2

(12) United States Patent
Hazellief, Sr.

(10) Patent No.: US 9,586,800 B2
(45) Date of Patent: Mar. 7, 2017

(54) DISPENSING FUNNEL

(71) Applicant: Daniel G. Hazellief, Sr., Frostproof, FL (US)

(72) Inventor: Daniel G. Hazellief, Sr., Frostproof, FL (US)

( * ) Notice: Subject to any disclaimer, the term of this patent is extended or adjusted under 35 U.S.C. 154(b) by 0 days.

(21) Appl. No.: 14/751,720

(22) Filed: Jun. 26, 2015

(65) Prior Publication Data

US 2016/0376138 A1 Dec. 29, 2016

(51) Int. Cl.
*B65B 39/00* (2006.01)
*B67C 3/22* (2006.01)

(52) U.S. Cl.
CPC ..... *B67C 3/22* (2013.01)

(58) Field of Classification Search
CPC ..... B65D 88/26
USPC ..... 222/470; 141/331, 345, 108
See application file for complete search history.

(56) References Cited

U.S. PATENT DOCUMENTS 1,752,047 A 3/1930 Harrison
2,674,375 A 4/1954 Clay
D208,261 S * 8/1967 Alkonis ..... 222/470
4,099,654 A 7/1978 Antolino
4,222,866 A 9/1980 Wilson
4,271,011 A 6/1981 Spencer et al.
D302,635 S 8/1989 Friedman
7,441,676 B2 10/2008 Pickering, Jr.
D628,861 S 12/2010 Lane
2008/0099512 A1 5/2008 Hoffman et al.

* cited by examiner

*Primary Examiner* — Jason K Niesz

(57) ABSTRACT

A dispensing funnel. The dispensing funnel and system comprise a generally trapezoidal hopper having an open slot along its bottom lip. Attached to the upper by of the hopper is a handle having an upper handle and side handle with a push button. The push button moves an actuating arm that covers the opening slot of the hopper through the use of a rod, spring stop, spring, and spring plate. A lower bracket having guard walls and funnel mounts is placed between the handle and the hopper that helps guide the actuating arm when in use. The dispensing funnel can be used in a method to cook by filling the hopper with a foodstuff, preferably grits, pushing the push button to allow a portion to escape the hopper into boiling water, and releasing the push button to prevent further foodstuff to exit the hopper. This allows for the controlled cooking of grits which prevents clumping and well as allows for more controlled cooking of foodstuff that require extra attention.

10 Claims, 4 Drawing Sheets

DISPENSING FUNNEL

BACKGROUND OF THE INVENTION

Field of the Invention

The present invention relates to a dispensing apparatus. More particularly, the present invention relates to a funnel designed for making grits in such a manner as to slowly introduce grits into a cooking environment in order to provide smooth, lumpless grits and method for doing so.

Description of the Background Art

People have been cooking grits for ages. The Native Americans traditionally made grits out of corn by grinding corn on a stone mill. The resulting hominy would be then passed through screens with the finer parts being used as grit meal and the coarser parts as grits. Grits have become such a part of society that several states have issued proclamations and laws governing them. For example, grits became the official prepared food of the state of Georgia in 2002.

The preparation of grits depends on the type of grits being cooked. So-called "quick" grits (which have the germ and hull of the corn removed) require less time cooking in boiling water than whole kernel grits. Grits expand when cooked and need periodic stirring to prevent sticking and to prevent lumps from forming. Currently, there exists a need for a way to make grits or other foodstuffs whereby a cook can introduce grits into a cooking environment in controlled amounts in order to prevent sticking and lumps.

For example, U.S. Pat. No. 2,674,375 to Clay discloses a reversible flour sifter where the user can put in an amount of flour and pull a trigger to allow some of the flour to escape the apparatus after it has been sifted. Clay discloses a better flour sifter but does not solve the problem of controlled release of a foodstuff such as grits or allow for the container to be refilled.

U.S. Application Publication 2008/0099512 to Hoffman et al. discloses a receptacle for measuring and dispersing flowable substances. Hoffman uses a moveable slide to allow for the dispersal of substances within its substantially funnel shaped container. However, Hoffman fails to provide an ergonomically designed grip and push button system for ease of use.

Therefore, it is an object of this invention to provide an improvement which overcomes the aforementioned inadequacies of the prior art devices and methods and provides an improvement which is a significant contribution to the advancement of the resting apparatus support art.

A further object of this invention is to provide an apparatus that allows for the controlled dispersal of foodstuffs while cooking.

A further object of this invention is to provide an apparatus that provides an ergonomic device for user comfort while cooking.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a dispensing tunnel having a trapezoidal hopper having an opening with an upper lip and lower lip wherein said lower lip has a slot along the longitudinal length of the lower lip of the container, a handle having an upper handle attached to the upper lip of the container and a side handle further comprising a push button attached to an upper rod, the upper rod attached to a displaceable spring stop having a lever point and a substantially rounded end, and a spring. The funnel has a lower bracket attached to the funnel's lower lip and a pair of guard walls ending in a pair of upwardly angled funnel mounts, a guide plane, a proximal and distal guide track, and an actuating arm comprising a lower bar having a proximal and distal end and an upper bar perpendicular to the lower bar wherein the lower bar is attached to the upper bar at the distal end. The actuating arm further comprises a vertical spring plate at the proximal end which interacts with the spring and spring stop.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures and methods for carrying out the same purposes of the present invention. It should also be realized by those skilled in the art that such equivalent constructions and methods do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The following description is of a preferred embodiment presently contemplated for carrying out the invention. This description is not to be taken in a limiting sense, but is made merely for the purpose of describing one or more preferred embodiments of the invention. The scope of the invention should be determined with reference to the claims.

Figure 1:
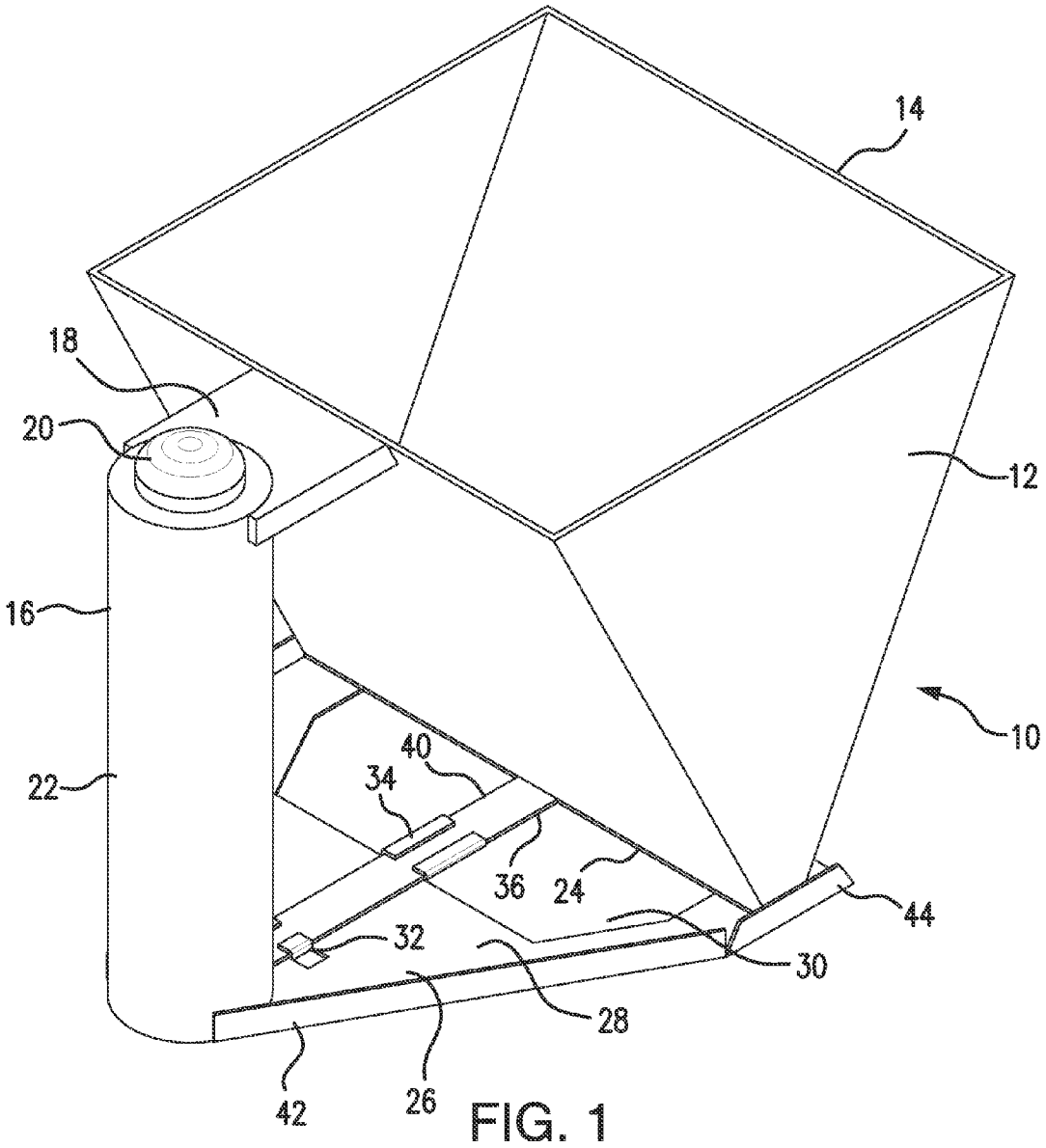
FIG. 1 is a perspective view of the dispensing funnel.

As can be seen FIG. 1, the dispensing funnel 10 features a hopper 12 having an upper lip 14 and a lower lip 24. The hopper 12 is preferably trapezoidal in shape. Attached to one side of the upper lip 14 is a handle 16 further comprising an upper handle 18, a push button 20, and a side handle 22. A base plate 26 is attached to the lower end of the side handle 22. This base plate 26 features a guide plane 28 that is preferably substantially triangular in shape. The base plate 26 has a pair of guide tracks, a proximal guide track 32 and a distal guide track 34, which help guide an actuating arm 36. The distal guide track 34 is preferably longer than the proximal guide track 32 to provide more support for the actuating arm 36 while in use, due the actuating arm's 36 top heavy configuration. The actuating 36 comprises an upper bar 38 which is preferably perpendicular to a lower bar 40, forming a T shape. The base plate 26 also features a set of side guards 42 and funnel mounts 44. The base plate 26 also has an opening 30.

Figure 2:
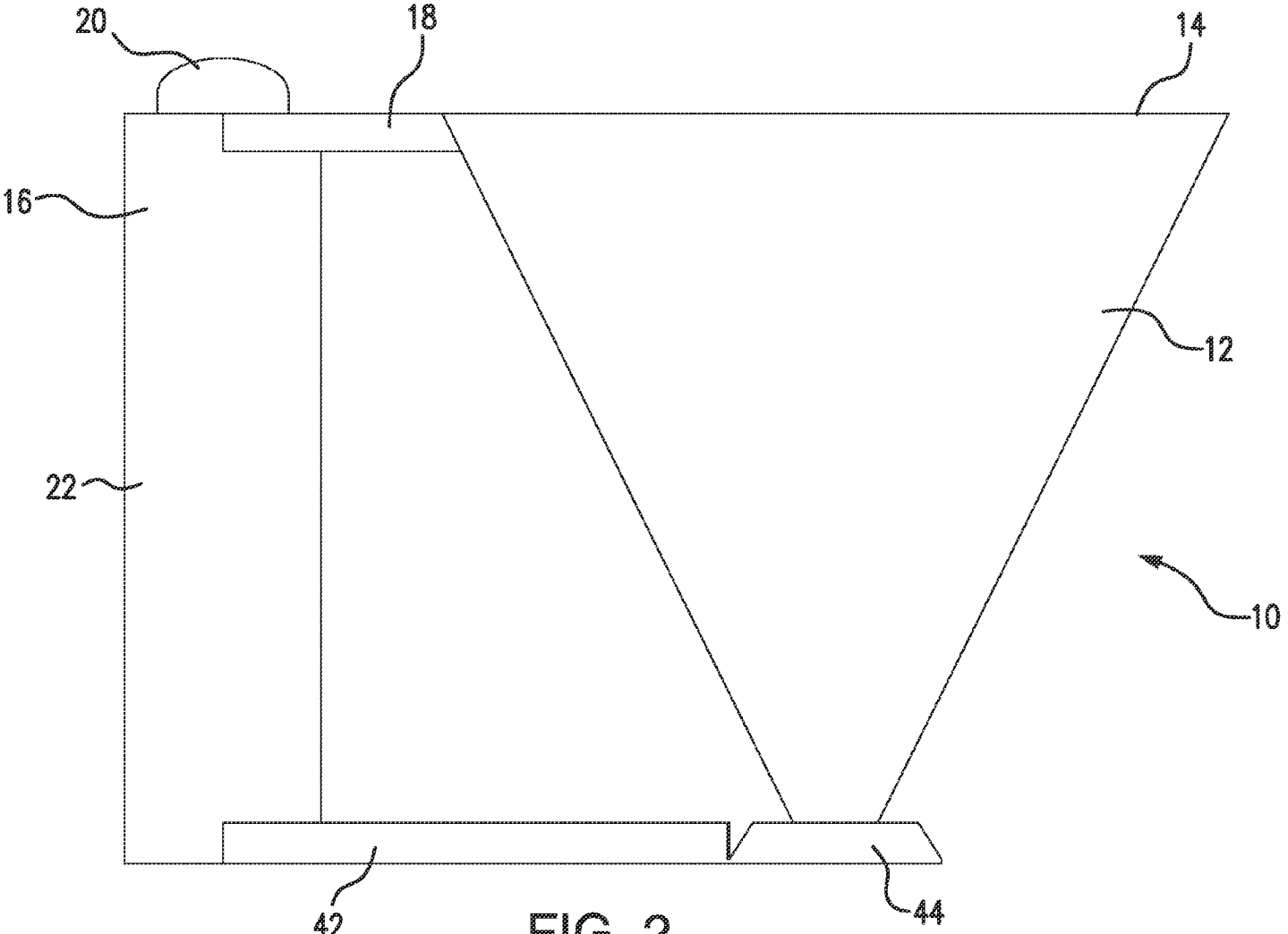
FIG. 2 is a side perspective view of the dispensing funnel.

As can be seen in FIG. 2, the side guards 42 and funnel mounts 44 are preferably upturned. Preferably the base plate 26 is made of some form of sheet metal or other malleable substance so that the side guards 42 and funnel mounts 44 can be formed. Additionally, the hopper 12 is preferably made out of a type of malleable sheet metal such as tin or aluminum for forming during production. It is preferable that the push button 20 be substantially hemispherical in shape for ergonomic comfort and for ease of use.

Figure 3:
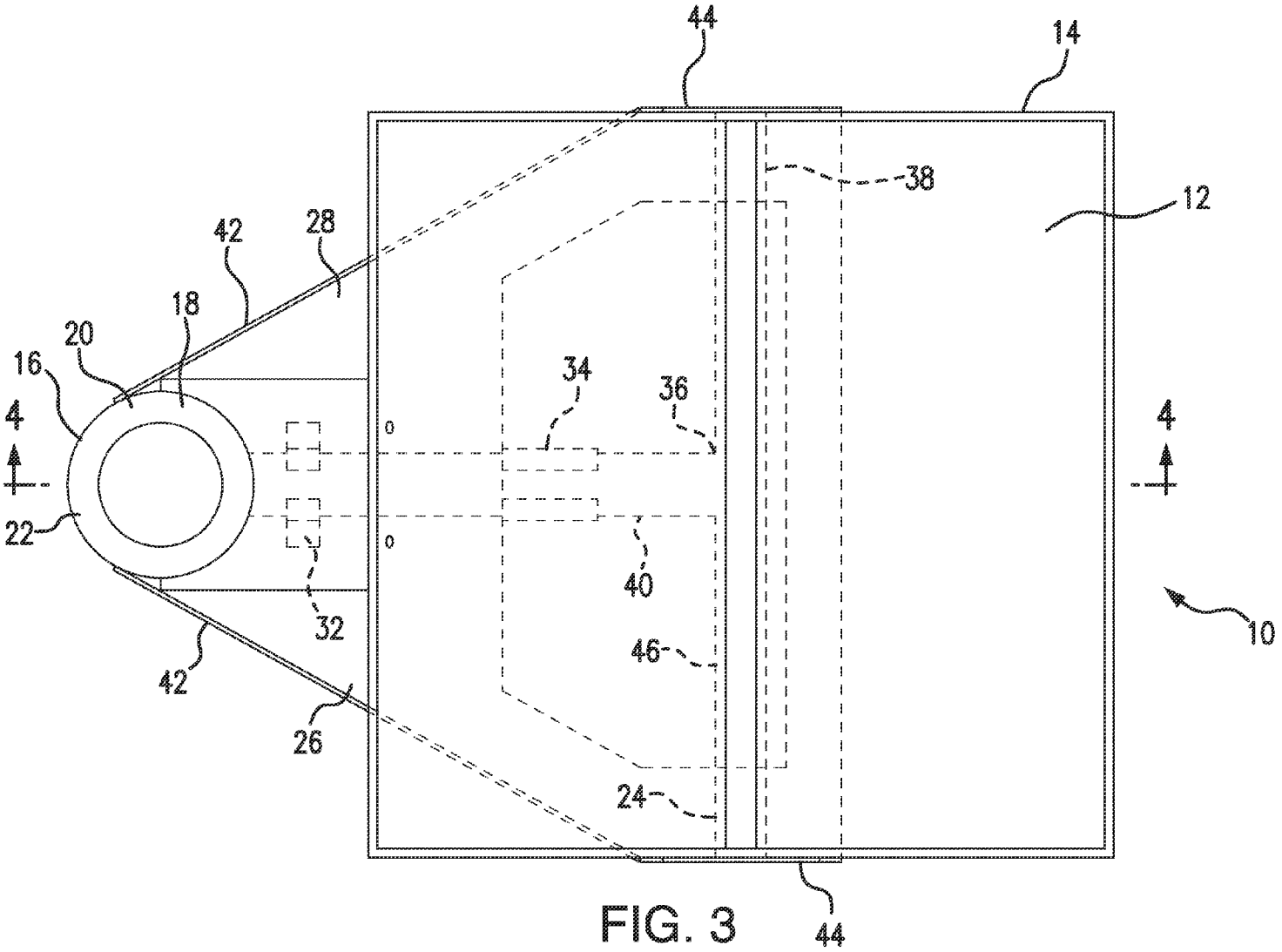
FIG. 3 is a top view of the dispensing funnel.

As can be seen in FIG. 3, the upper bar 40 of actuating arm 36 extends across the entire length of the hopper 12. The hopper 12 has a lower lip 24 comprising a slot 46 which is sealingly engaged by the upper bar 40 when the actuating arm 36 is in the resting position. Preferably, when viewed from the top, the upper handle 18 and hopper 12 block any view of the actuating arm 36 except for the part of the upper bar 40 that can be seen through the slot 46. When in use, a user pushes the push button 20 and the actuating arm 36 disengages from the slot 46. This allows whatever is loaded into the hopper 12 to escape through the slot 46. Preferably, for this invention, foodstuffs such as grits are loaded into the hopper 12. However, any granular product can be used with the present invention.

Figure 4:
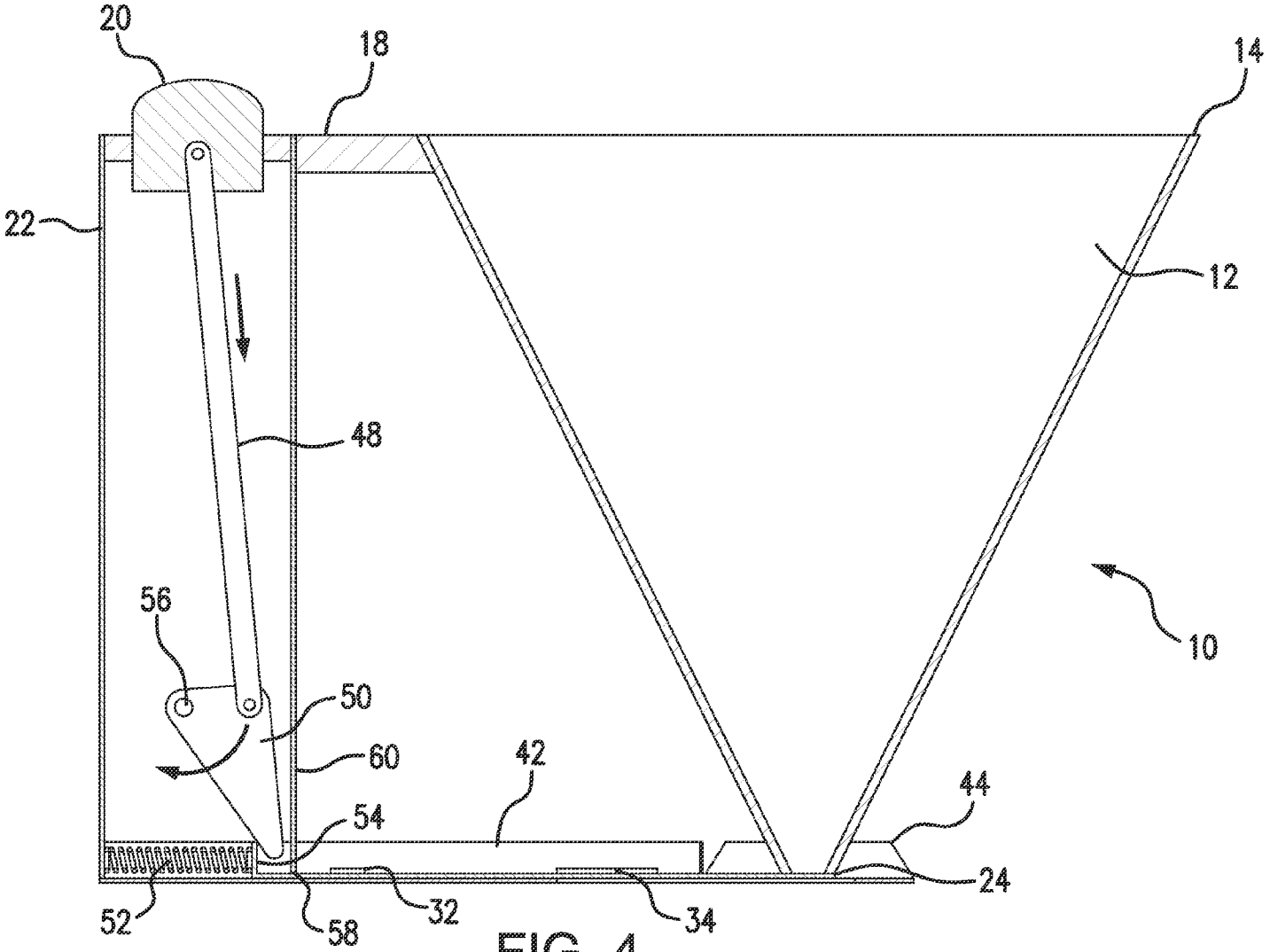
FIG. 4 is a cross-sectional view of the dispensing funnel.

FIG. 4 provides a cross-sectional view of the dispensing funnel 10 and a better view of the mechanism provided to displace the actuating arm 36. When the push button 20 is pressed, an upper rod 48 is forced downward. This upper rod 48 is attached to a spring stop 50. The downward force caused by pressing the push button 20 forces the spring stop 50 to displace around a lever point 56. This allows for a preferably helical spring 52 to compress or extend. The spring 52 preferably has enough tensile strength to maintain the actuating arm 36 in a resting position where the upper bar 38 covers the slot 46. The actuating arm 36 features a perpendicular end wall 54 which sits between the spring 52 and the spring stop 50. This is due to the spring stop 50 having a substantially triangular shape. This means that when the push button 20 is pushed, causing the upper rod 48 to displace the spring stop 50, the actuating arm 36 gets displaced correspondingly laterally, depending on the direction of displacement of the spring stop 50. Depending on preference, the spring stop 50 can shift away from the spring 52, forcing the actuating arm 36 forward, or the spring stop 50 can shift towards the spring 52, forcing the actuating arm 36 backward. Either displacement direction will allow for whatever is loaded into the hopper 12 to escape through the slot 46.

As can also be seen in FIG. 4, the side handle 22 is generally hollow. There is an slide hole 58 formed in the side walls 60 of the side handle 22 for the actuating arm 36 to enter the side handle 22 and interact with the spring stop 50 and spring 52. Preferably, the slide hole 58 is only wide and tall enough to allow ease of movement for the actuating arm 36.

The present disclosure includes that contained in the appended claims, as well as that of the foregoing description. Although this invention has been described in its preferred form h a certain degree of particularity, it is understood that the present disclosure of the preferred form has been made only by way of example and that numerous changes in the details of construction and the combination and arrangement of parts and methods may be resorted to without departing from the spirit and scope of the invention.

What is claimed is:

1. A dispensing funnel comprising:

a trapezoidal hopper with an upper lip and lower lip wherein said lower lip has a slot along the longitudinal length of the lower lip of the hopper;

a handle having an upper handle attached to the upper lip of the hopper and a side handle further comprising:

a push button attached to an upper rod;

the upper rod attached to a displaceable spring stop having a lever point and a substantially rounded end; and a spring;

a lower bracket connected to the handle and lower lip of the hopper further comprising:

a pair of guard walls ending in a pair of upwardly angled funnel mounts;

a guide plane having an opening;

a proximal and distal guide track; and a laterally moving actuating arm comprising a first bar having a proximal and distal end and a second bar perpendicular to the first bar wherein the first bar is attached to the second bar at the distal end, the first bar further comprising a vertical spring plate at the proximal end of the first bar located between the displaceable spring stop and the spring.

2. A dispensing funnel comprising:

a hopper having an open slot and a handle;

a lower bracket connected to the handle with an actuating arm;

the handle further comprising a push button which actuates the actuating arm, wherein the actuating arm has a first bar and a second bar wherein the first bar is perpendicular to the second bar.

3. The dispensing funnel of claim 2 wherein the push button moves the actuating arm through the use of a rod, a displaceable spring stop, a spring, and a vertical spring plate.

4. The dispensing funnel of claim 3 wherein the displaceable spring stop is able to shift both toward the hopper and away from the hopper, forcing the actuating arm to move laterally away from the handle or laterally toward the handle respectively.

5. The dispensing funnel of claim 2 wherein the lower bracket further comprises a pair of guard walls ending in a pair of upwardly angled funnel mounts, a guide plane, a proximal guide track and a distal guide track.

6. The dispensing funnel of claim 5 wherein the distal guide track is longer than the proximal guide track.

7. The dispensing funnel of claim 5 wherein the funnel mounts have a length equal to the maximum displacement of the actuating arm.

8. The dispensing funnel of claim 2 wherein the actuating arm moves laterally.

9. The dispensing funnel of claim 2 wherein the lower bracket further comprises a proximal and a distal guide track to guide the actuating arm.

10. The dispensing funnel of claim 2 wherein the lower bracket further comprises an opening having a larger area than the open slot of the hopper.

* * * * *